US005242053A

United States Patent [19]

Rowe

[11] Patent Number: 5,242,053

[45] Date of Patent: Sep. 7, 1993

[54] CARRIER STRIP FOR TUBULAR STRUCTURE

[75] Inventor: Douglas Rowe, La Jolla, Calif.

[73] Assignee: ALCYON Innovations In Biotechnology, La Jolla, Calif.

[21] Appl. No.: 935,024

[22] Filed: Aug. 25, 1992

[51] Int. Cl.[5] ..... B65D 85/20

[52] U.S. Cl. ..... 206/446; 206/459.5

[58] Field of Search ..... 206/330, 443, 446, 459.5, 206/488, 490, 562, 563, 569, 570

[56] References Cited

U.S. PATENT DOCUMENTS

| | | | |
|---|---|---|---|
| 3,342,327 | 9/1967 | Newton | 206/347 |
| 4,019,631 | 4/1977 | Lejdegard et al. . | |
| 4,363,401 | 12/1982 | Savagian | 206/820 |
| 4,488,642 | 12/1984 | Changani et al. | 206/820 |
| 4,651,873 | 3/1987 | Stolenberg et al. . | |
| 4,865,895 | 9/1989 | Vlamings et al. | 206/820 |
| 5,024,330 | 6/1991 | Serve | 206/486 |
| 5,090,607 | 2/1992 | Ohuchi et al. | 206/346 |
| 5,115,911 | 5/1992 | Schulte et al. . | |

FOREIGN PATENT DOCUMENTS 0267871 5/1988 European Pat. Off. ..... 206/459.5

*Primary Examiner*—Jimmy G. Foster
*Attorney, Agent, or Firm*—Dilworth & Barrese

[57] ABSTRACT

A carrier strip is provided having at least one void therein adapted to firmly and releasably hold a tubular structure therein. The carrier strip is preferably formed of a flexible or resilient plastic and includes a surface for permanent labeling thereof. The voids may be formed in a variety of sizes in the same strip or, alternatively, strips having voids of uniform sizes can be joined together. Carrier strips may also be color coded and formed with a plurality of voids sized to accommodate several popular test tube sizes and configurations. Labeling surfaces are provided adjacent each void to facilitate individual identification of the test tube held therein. The carrier strip portion defining the voids may also be formed to completely or only partially encircle the tubular structure.

20 Claims, 2 Drawing Sheets

CARRIER STRIP FOR TUBULAR STRUCTURE

BACKGROUND OF THE INVENTION

1. Field of the Invention

The present invention relates to carrier strips for tubular structure, and more particularly to a carrier strip for labeling, grouping and/or handling small tubular structures such as laboratory test tubes.

2. Description of the Related Art

A wide variety of tubular structures are currently in use in the medical, biological and chemical fields for storage, transport and organization of fluids and solids. These structures are typically in the form of glass or plastic test tubes and come in a large number of shapes and sizes. Laboratory practice requires extremely accurate and dependable labeling and handling of test tubes. Typically, these test tubes are organized, transported and/or stored in racks or frames. Given the variety of sizes and shapes of test tubes, these racks are not generally adapted to securely hold the test tubes and, further, are not readily adaptable for labeling and accurate organization. Similarly, the smooth texture of the test tube walls make direct labeling and identification difficult. These difficulties can result in accidental spillage, loss of specimens, and increased errors and misapplications of the test tube contents. Therefore, there is a clear need for a system and apparatus which permits accurate and secure labeling, grouping and handling of test tube type structure, particularly in the laboratory setting.

The use of tape structure for transportation manipulation and/or organization is generally known. Carrier tapes are commonly used in the manufacturing industry to move miniature or subminiature components or products from various manufacturing stations in connection with production and assembly operations. See, for example, U.S. Pat. No. 5,115,911 to Schulte et al. Similarly, tape structure has been utilized in the packaging and organization of small items such as nails, screws and bolts. This structure is illustrated in U.S. Pat. No. 4,019,631 to Lejdegard et al. As shown, the screws or bolts are threaded into holes formed in a strip of material such as, for example, nylon. The strip then serves as package for the items. None of the above-identified tape structures are contemplated or suggested for use in the identification, organization, handling and/or transportation of tubular structure in scientific or laboratory settings.

Accordingly, in response to the inadequacies of current laboratory practices, it is an object of the present invention to provide a carrier strip for tubular structure which provides improved identification, labeling, organization, handling and/or transportation of tubular structures such as laboratory test tubes.

It is a further object of the present invention to provide a carrier strip wherein tubular structure is easily inserted into and removed from the strip.

Another object of the present invention is to provide a carrier strip which can firmly secure the tubular structure without damage and will not disengage if dropped or inverted.

A further object of the present invention is to provide a carrier strip which is easily labeled and adapted for efficient organization.

Another object of the present invention is to provide a carrier strip which can be visually coded for ease of identification and organization.

It is another object of the present invention to provide a carrier strip which is adapted to hold a plurality of tubular structures together.

A further object of the present invention is to provide a carrier strip which is easily inserted into and securely held by laboratory instrumentation and apparatus thus inhibiting the disengagement, loss or spillage of the tubular structure retained therein.

Another object of the present invention is to provide a carrier strip which can be quickly and easily customized to hold a wide variety and number of tubular structures.

SUMMARY OF THE INVENTION

In accordance with these objectives, the present invention embodies a carrier strip having at least one void therein adapted to firmly and releasably hold a tubular structure therein. The carrier strip is preferably formed of a flexible or resilient plastic and includes a surface for permanent labeling thereof. Where a plurality of tubular structures are to be grouped together, the carrier strip can be formed in an elongated strip containing a plurality of voids therein sized to receive the tubular structures. The voids may be formed in a variety of sizes in the same strip or, alternatively, strips having voids of uniform sizes can be joined together. In particularly preferred embodiments color coded carrier strips are formed with a plurality of voids sized to accommodate several popular test tube sizes and configurations. Labeling surfaces are provided adjacent each void to facilitate individual identification of the test tube held therein. The voids may be formed in a wide variety of configurations and preferably correspond to the cross-sectional configuration of the tubular structure to be retained. The carrier strip portion defining the voids may also be formed to completely or only partially encircle the tubular structure.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, and wherein.

DETAILED DESCRIPTION OF PREFERRED EMBODIMENTS

Figure 1:
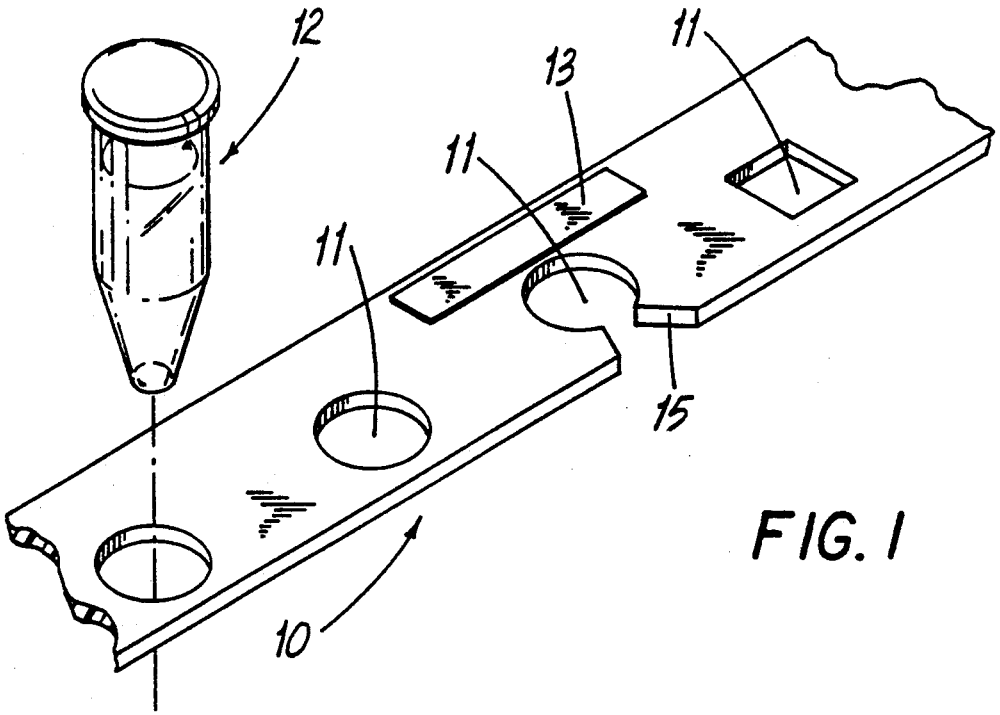
FIG. 1 is a perspective view of a carrier strip for tubular structure in accordance with one embodiment of the present invention.

Referring now in detail to the drawings and in particular to FIG. 1, there is shown a carrier strip for tubular structure in accordance with one preferred embodiment of the present invention. The carrier strip, shown generally at 10, is preferably formed of a resilient material such as, for example, vinyl or nylon. Other suitable materials include paper and plastic materials such as polyvinyl chloride, polypropylene and polyester. In this embodiment, the strip material is selected to provide an integral surface portion capable of indelibly retaining permanent labeling for the tubular structure to be retained. Alternatively, a separate strip material such as adhesive backed paper can be adhered to the strip material to facilitate identifying a characteristic of the tubular structure to be retained.

Voids 11 are formed in carrier strip 10 and are sized and dimensioned to retain tubular structure therein. In the embodiment shown in FIG. 1, voids 11 are arranged along a longitudinal axis of the carrier strip 10 and are formed in varying sizes and shapes to accommodate a wide variety of tubular structure. Similarly, notches 15 may be formed in the carrier strip 10 adjacent some or all of the voids 11 to facilitate insertion and/or removal of the tubular structure.

Figure 2:
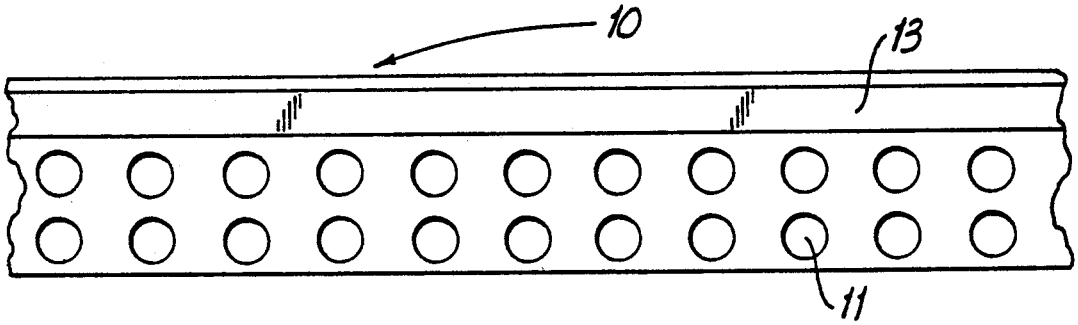
FIG. 2 is a top plan view of a carrier strip for tubular structure having uniform circular voids formed therein.
Figure 3:
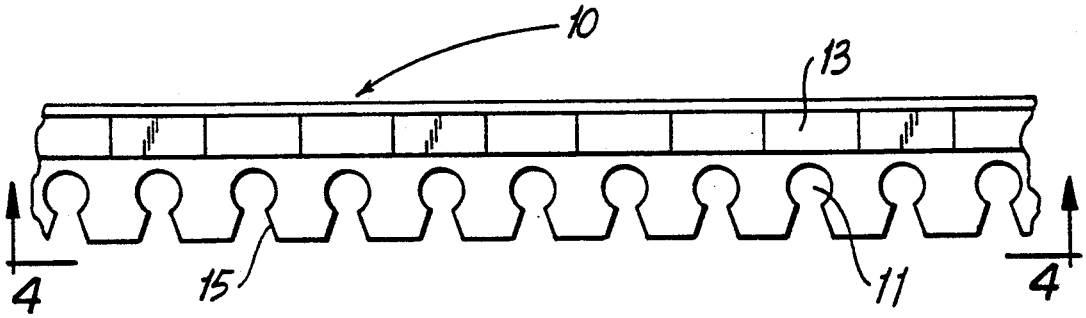
FIG. 3 is a top plan view of a carrier strip for tubular structure having uniform open semi-circular voids formed therein.

In the embodiment of FIG. 1, an integral surface portion 13 of the carrier strip 10 adjacent at least one void 11 is textured to permit accurate and secure labeling of a characteristic of the tubular structure to be disposed therein. Alternatively, as shown in FIGS. 2 and 3, the surface portion can extend, either continuously (FIG. 2) or discontinuously (FIG. 3) along at least one surface of the carrier strip 10. These configurations permit the user to customize each application of the carrier strip 10 by cutting the strip to the desired length. It is also contemplated that at least a portion of the carrier strip 10 can be formed in a predetermined color or with a predetermined code such as, for example, an alpha-numeric code to further facilitate organization and identification of tubular structure to be retained by the carrier strip.

Tubular structure such as, for example, test tube 12 is readily insertable into carrier strip 10. Because at least a portion of the carrier strip 10 defining the voids 11 is preferably formed of a resilient material, the test tube 10 is securely held therein and prevents accidental disengagement, losses and spills. The resilient material further facilitates removal of the test tube as desired. Although only a cylindrical test tube is shown, it is contemplated that a wide variety of tubular structure can be retained and identified by the carrier strip of the present invention. For example, tubular structure having circular, oval, elliptical, square, rectangular or trapezoidal cross sections could be used.

FIG. 2 illustrates another embodiment of the present invention wherein the carrier strip 10 is formed of an elongated flexible sheet material with a continuous identification portion 13 formed along a longitudinal axis thereof. A plurality of uniformly sized voids 11 are formed in two longitudinal rows parallel to identification portion 13. This configuration is particularly useful where a large number of tubular structures of uniform size are to be handled.

Figure 4:
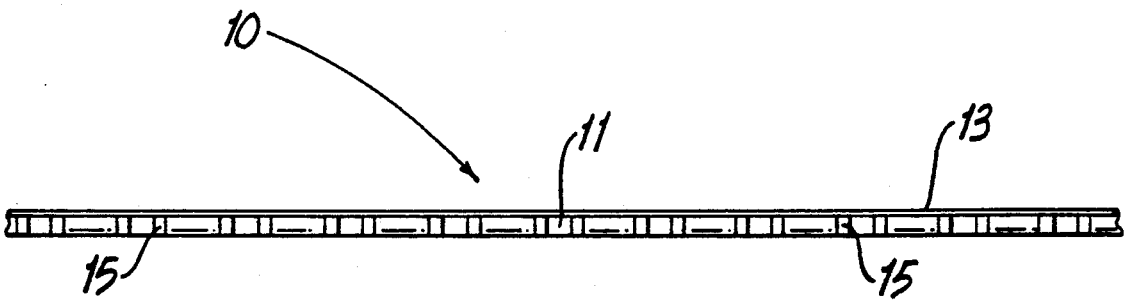
FIG. 4 is a side plan view of the carrier strip of FIG. 3 taken along line 4–4.

Referring to FIGS. 3 and 4 there is shown another embodiment of the present invention. Carrier strip 10 includes a discontinuous identification portion 13 formed of an adhesive back paper sheet material adhered to a top surface of the carrier strip. Also, a portion of the carrier strip 10 adjacent each of the voids 11 is provided with a notch 15 to facilitate insertion of the tubular structure. These notches 15 also permit the voids to expand to compensate for relatively small variations in the outer dimensions of the tubular structure.

Figure 5:
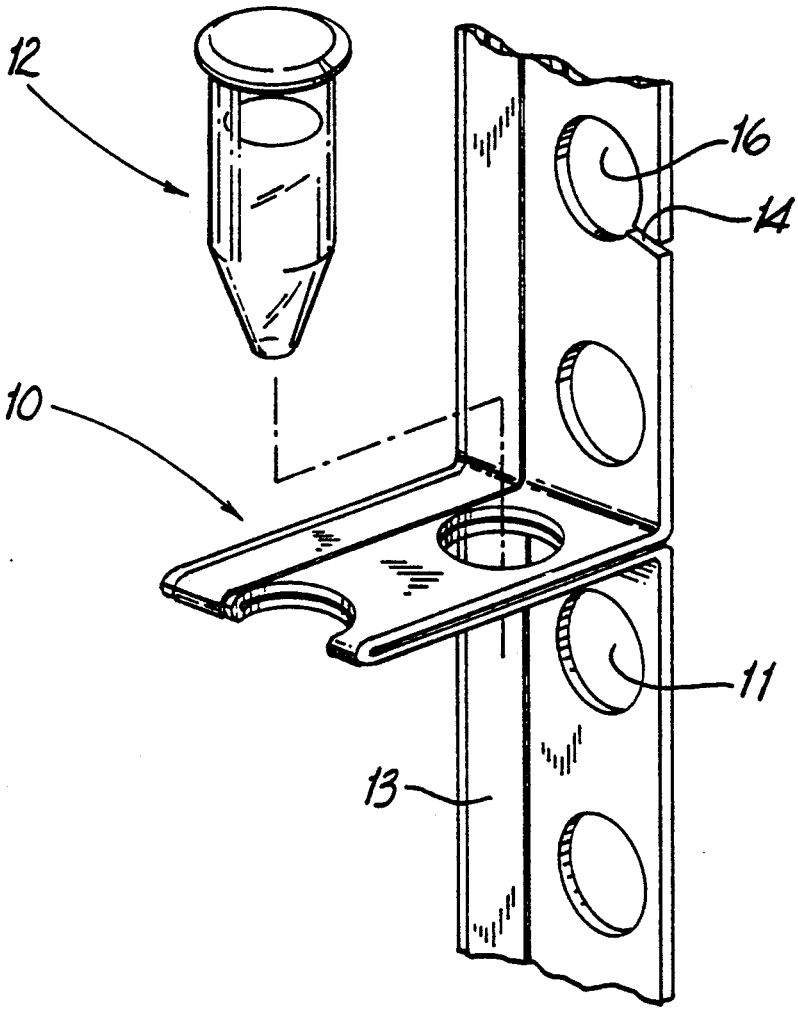
FIG. 5 is a perspective view of a carrier strip for tubular structure wherein the carrier strip is folded to retain the tubular structure in at least two voids.

FIG. 5 shows a further embodiment of the present invention as well as an alternative holding position for tubular structure therewithin. Carrier strip 10 is formed of an elongated flexible sheet material and includes a continuous textured identification portion 13 formed on at least one surface thereof along a longitudinal axis of the carrier strip 10. A plurality of voids 11 are formed along a longitudinal axis substantially parallel to the identification portion 13. For illustrative purposes, one of the voids 16 is provided with a slit 14 which permits relative expansion of the void to accommodate variations in the dimensions of the tubular structure.

In order to further improve the securement of the tubular structure, carrier strip 10 is folded upon itself such that a portion of the bottom surfaces of the carrier strip are in abutting relation and at least two of the voids 11 are in axial alignment. Test tube 12 is then inserted through the axially aligned voids 11 and is securely retained therein.

It is also contemplated that corresponding carrier strips can be joined together by engagement means. In its simplest embodiment, corresponding ends of two carrier strips can be stapled together or, alternatively, two carrier strips can be overlapped such that at least one void on one strip is in axial alignment with at least one void on the other strip. A tubular structure or joining member can then be inserted through both voids to join the two strips.

While there has been illustrated and described what is at present considered to be preferred embodiments of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that the present invention not be limited to the particular embodiments disclosed as the best modes contemplated for carrying out the invention, but that the invention will be accorded all embodiments falling within the scope of the appended claims.

What is claimed is:

1. A carrier strip for tubular structure comprising:

a strip of sheet material having at least one void therein adapted to secure a tubular structure;

a tubular structure positioned in said void; and identification means integral with said strip and adjacent said void for identifying a characteristic of said tubular structure positioned in said void.

2. A carrier strip as in claim 1 wherein at least a portion of said carrier strip defining said void is formed of a flexible material.

3. A carrier strip as in claim 1 wherein said identifying means comprises a portion of said carrier strip adapted to indelibly receive identifying indicia of said characteristic of said tubular structure.

4. A carrier strip as in claim 3 wherein said portion of said carrier strip adapted to indelibly receive identifying indicia comprises a textured surface adapted to receive written identifying indicia for said tubular structure.

5. A carrier strip as in claim 1 wherein said tubular structure comprises a test tube.

6. A carrier strip as in claim 1 wherein said identification means comprises a portion of said carrier strip which is color coded to provide identification of said characteristic of said tubular structure.

7. A carrier strip for tubular structure comprising:

an elongated strip of flexible sheet material having a plurality of voids formed therein, said voids being sized and dimensioned to removably secure at least one tubular structure therein; at least one tubular structure positioned in at least one of said plurality of voids; and identification means integral with said strip and adjacent said void for visually identifying a characteristic of said at least one tubular structure.

8. A carrier strip as in claim 7 wherein said carrier strip is formed from a material selected from the group consisting of nylon, vinyl, polyvinyl chloride, polypropylene and polyester.

9. A carrier strip as in claim 7 wherein said voids are dimensioned to accommodate at least two different sizes of tubular structure.

10. A carrier strip as in claim 7 wherein said voids are completely defined about their entire periphery by said carrier strip.

11. A carrier strip as in claim 7 wherein said voids are aligned along a longitudinal axis of said elongated strip of flexible sheet material.

12. A carrier strip is as in claim 7 wherein said carrier strip is color coded to provide identification of said characteristic of said tubular structure.

13. A carrier strip as in claim 7 wherein said identification means comprised a textured portion of said flexible sheet material adjacent at least one of said voids, said textured portion being configured and dimensioned to receive written indicia of said characteristic of said tubular structure.

14. A carrier strip for tubular structure comprising:

an elongated strip of flexible sheet material defining a longitudinal axis and a transverse axis, said carrier strip having a multiplicity of voids formed therein, each of said voids being substantially aligned along said longitudinal axis of said sheet material and being sized and dimensioned to removably secure a plurality of tubular structure therein, said elongated strip further including identification means integral with said strip and adjacent said voids for identifying a characteristic of said tubular structure and a plurality of tubular structures positioned in said voids.

15. A carrier strip as in claim 14 wherein said voids are defined entirely within said elongated strip of flexible sheet material.

16. A carrier strip as in claim 14 wherein said voids are all formed in a uniform size and dimension.

17. A carrier strip as in claim 14 wherein said carrier strip further includes engagement means for attachment to a second carrier strip.

18. A carrier strip as in claim 14 wherein said carrier strip is formed with a preselected visual indicator as an integral part thereof.

19. A carrier strip as in claim 18 wherein said preselected visual indicator comprises color coding of said carrier strip.

20. A carrier strip for tubular structure comprising:

at least two strips of sheet material each having at least one void therein adapted to secure a tubular structure;

a tubular structure positioned in at least one of said voids in each of said strips of sheet material; and identification means integral with said strip and adjacent at least one of said voids for identifying a characteristic of said tubular structure.

* * * * *